US007568294B2

(12) United States Patent
Sung

(10) Patent No.: US 7,568,294 B2
(45) Date of Patent: Aug. 4, 2009

(54) COMBINATION BALL CLIP AND BALL LINER AND BALL CLIP FOR USE WITH A BALL LINER

(76) Inventor: Min Hsien Sung, 2F-1, 10, Sec. 1, Zhongxing Road, Wugu Township, Taipei County (TW)

( * ) Notice: Subject to any disclaimer, the term of this patent is extended or adjusted under 35 U.S.C. 154(b) by 34 days.

(21) Appl. No.: 11/968,921

(22) Filed: Jan. 3, 2008

(65) Prior Publication Data

US 2008/0271334 A1 Nov. 6, 2008

Related U.S. Application Data

(63) Continuation-in-part of application No. 11/742,805, filed on May 1, 2007, now abandoned.

(51) Int. Cl.
*G01B 3/14* (2006.01)
*B25B 5/14* (2006.01)

(52) U.S. Cl. ..... 33/562; 33/21.2; 101/DIG. 40; 269/268

(58) Field of Classification Search ..... 33/21.1, 33/21.2, 562; 101/35, DIG. 40; 269/239, 269/268, 269, 270; 473/378
See application file for complete search history.

(56) References Cited

U.S. PATENT DOCUMENTS

| | | | | |
|---|---|---|---|---|
| 3,878,762 | A * | 4/1975 | Goldsmith | 33/21.2 |
| 4,083,547 | A * | 4/1978 | Gurley | 269/239 |
| 5,181,325 | A * | 1/1993 | Damon | 33/562 |
| 5,878,659 | A * | 3/1999 | Hatter | 101/35 |
| 6,004,223 | A * | 12/1999 | Newcomb | 101/DIG. 40 |
| 6,179,732 | B1 * | 1/2001 | Inoue et al. | 473/378 |
| 6,705,217 | B1 * | 3/2004 | Godsey et al. | 101/35 |
| 6,893,012 | B2 * | 5/2005 | Wong | 269/268 |
| 7,004,067 | B1 * | 2/2006 | Godsey et al. | 101/35 |
| 7,047,877 | B2 * | 5/2006 | Powney et al. | 101/35 |
| 2002/0005124 | A1 * | 1/2002 | Parks | 101/127 |
| 2006/0144262 | A1 * | 7/2006 | Koong | 101/DIG. 40 |
| 2007/0021231 | A1 * | 1/2007 | Rutherford | 101/DIG. 40 |

FOREIGN PATENT DOCUMENTS

| | | |
|---|---|---|
| TW | M272563 | 8/2005 |
| TW | 200727946 | 8/2007 |

* cited by examiner

*Primary Examiner*—G. Bradley Bennett

(57) ABSTRACT

A combination ball clip and ball liner includes a ball liner for marking a club head guideline, a directional guide line and a 360° horizontal guideline on a golf ball, and a ball clip for holding down a golf ball in the ball liner for marking guidelines. The ball clip includes a hollow mounting block fastened to the ball liner, a smoothly arched clip body pivoted to the hollow mounting block, and an elastic member mounted in the hollow mounting block to bias the smoothly arched clip body, holding the smoothly arched clip body in the ball-holding position.

11 Claims, 13 Drawing Sheets

COMBINATION BALL CLIP AND BALL LINER AND BALL CLIP FOR USE WITH A BALL LINER

This application is a continuous-in-part application of U.S. patent application Ser. No. 11/742,805, filed on May 1, 2007 now abandoned.

BACKGROUND OF THE INVENTION

1. Field of the Invention

The present invention relates to a ball liner for marking aiming lines on a golf ball and more particularly, to such a ball liner that is equipped with a ball clip for holding down a golf ball for marking aiming lines.

2. Description of the Related Art

Playing the game of golf brings pleasure and spiritual encouragement, however it requires practice and skill. The keypoint in performing the game of golf is to make sure of the hitting angle. The hitting angle controls the moving direction of the ball. Biasing of the hitting angle will drive the ball out of the course, and the ball will not fall to the expected location. The ball structure, hitting location, hitting angle, club swinging manner are important factors that determine the performance. Therefore, using a scientific method to calculate all ball-hitting parameters help improvement of the performance.

Taiwan patent publication number M272563 discloses a ball line marker. This design of ball line marker comprises a semispherical top cover and a semispherical base. This design of ball line maker allows the user to draw aiming lines on the surface of a golf ball. However, before using the ball line maker to draw lines on the ball, the user must adjust the position of the ball in the semispherical base and then close the semispherical top cover so as not to draw a line over the trademark or logo at the ball. Further, this design of ball line maker cannot help the user draw an endless horizontal line, or multiple lines in different directions at one cycle. Before drawing a nex aiming line, the user must open the semispherical top cover and adjust the position of the ball in the semispherical base. Further, the ball line marker cannot help the user draw connected lines, or an endless line around the periphery of the ball. Although the semispherical base has a circular bottom adjustment hole for the insertion of a finger to rotate the ball and to further adjust the position of the ball in the semispherical base, the use still cannot accurately check the position of the ball through the line or marking holes of the semispherical top cover when rotating the ball in the semispherical base. Therefore, when drawing an aiming line, the aiming line may extend over the trademark or logo of the ball.

Further, Taiwan Patent publication No. 200727946 discloses a ball line marker that allows the user to draw a circumferential line on a golf ball. However, it does not allows the user to draw other guidelines on a golf ball. Further, the accommodation hole of the ball line marker cannot hold the loaded golf ball in position. When marking the golf ball, the golf ball may displace in the accommodation hole, causing interruption of the marking line.

Further, U.S. Ser. No. 11/742,805 discloses a ball liner for marking multiple lines on a golf ball. This design is an invention of the present inventor. This design of ball liner is functional, however there is room for improvement, more particularly the arrangement between the retainer and the through hole. When separating the retainer from the through hole, the retainer must be compressed to reduce its dimension and to have the maximum width of the retainer become smaller than the diameter of the through hole so that the retainer can be moved out of the through hole. Returning the retainer to its former position needs to reverse the aforesaid process. This operation is complicated, wasting much time, and causing the retainer to wear quickly.

Except the hitting face that affects the flying path of the ball, the location of the center of gravity also affects the flying distance and path of the ball. For example, when putting a golf ball that has its center of gravity biased from the center of the ball, the center of gravity of the golf ball will affect the direction of rotation of the golf ball, causing the golf ball to move out of the expected path. To either a practitioner or professional, the player must take every shot seriously.

SUMMARY OF THE INVENTION

The present invention has been accomplished under the circumstances in view. It is one object of the present invention to provide a ball clip for use with a ball liner, which holds down a golf ball firmly in the ball liner, enabling the user to mark guidelines on the golf ball positively and accurately. It is another object of the present invention to provide a combination ball clip and ball liner, which includes a ball liner for marking a club head guideline, a directional guide line and a 360° horizontal guideline on a golf ball, and a ball clip for holding down a golf ball in the ball liner for marking guidelines.

To achieve this and other objects of the present invention, the ball clip comprises a smoothly arched clip body for holding down a golf ball in said ball liner that a front end, a rear end, a grip extending from the front end, a pivot hole transversely cut through the rear end, and a protruding block protruded from the periphery of the rear end, a hollow mounting block that is fastened to the ball liner and has an opening, a bottom wall, a peripheral wall, an accommodation chamber surrounded by the bottom wall and the peripheral wall and disposed in communication with the opening, and two pivot holes cut through the peripheral wall and axially aligned at two sides above the opening, a pivot pin fastened to the pivot holes of the hollow mounting block and the pivot hole of the smoothly arched clip body to pivotally secure the smoothly arched clip body to the hollow mounting block, and an elastic member mounted in the accommodation chamber and stopped the bottom wall of the hollow mounting block and the protruding block of the smoothly arched clip body to impart an upward pressure to the protruding block of the smoothly arched clip body.

Further, the grip has an anti-slip pattern for positive gripping with the fingers to move the smoothly arched clip body between the ball-holding down position and the ball-releasing position for loading/unloading of a golf ball.

The ball clip is easy to operate. The ball clip has a simple structure that saves much material. Therefore, the ball clip is inexpensive to manufacture. By means of the ball clip, the gold ball that is put in the ball liner is firmly secured in place for marking guidelines. When the user is marking a guideline on the golf ball, the golf ball does not rotate in the ball liner. In case of an interruption when marking a guideline, the user can draw a perfect guideline when resume marking the guideline. Further, the hollow mounting block is directly attached to the border edge of the ball line without any fastener, and the positioning of the hollow mounting block on the ball liner does not hinder the user from using the ball liner to mark guidelines on a golf ball. Frequently turning the smoothly arched clip body between the ball-holding position and the ball-releasing position does not cause the ball clip to wear. Simply by lifting the smoothly arched clip body from the ball-holding position to the ball-releasing position, the position of the golf ball in the ball liner can then be adjusted.

Further, by means of the ball liner, the user can draw a directional guideline on a golf ball after check of the center of gravity of the golf ball. The user can also draw a 360° guideline on a golf ball along the seam of the golf ball. By means of the guidance of the 360° guideline, the user can accurately control the balance of the rotation of the golf ball when putting the golf ball on the green toward the hole.

Further, the ball clip and the ball liner may be respectively marked with a mark for alignment of marks that are marked on the golf ball corresponding to its center of gravity so that the user can draw the correct guidelines on the golf ball.

Further, when the ball clip is fastened to the ball liner, the front end of the smoothly arched clip body is kept spaced from the annular scale of the ball liner. Therefore, the user can draw a 360° guideline around the circumference of the golf ball without interruption.

The invention can also help a golf game beginner in a golf practice yard to visually aim the contact between the golf ball and the golf club at the target. When the contact angle between the golf ball and the golf club is checked, the user can then check the performance and find the problem in hitting the ball.

DETAILED DESCRIPTION OF THE PREFERRED EMBODIMENT

Figure 1:
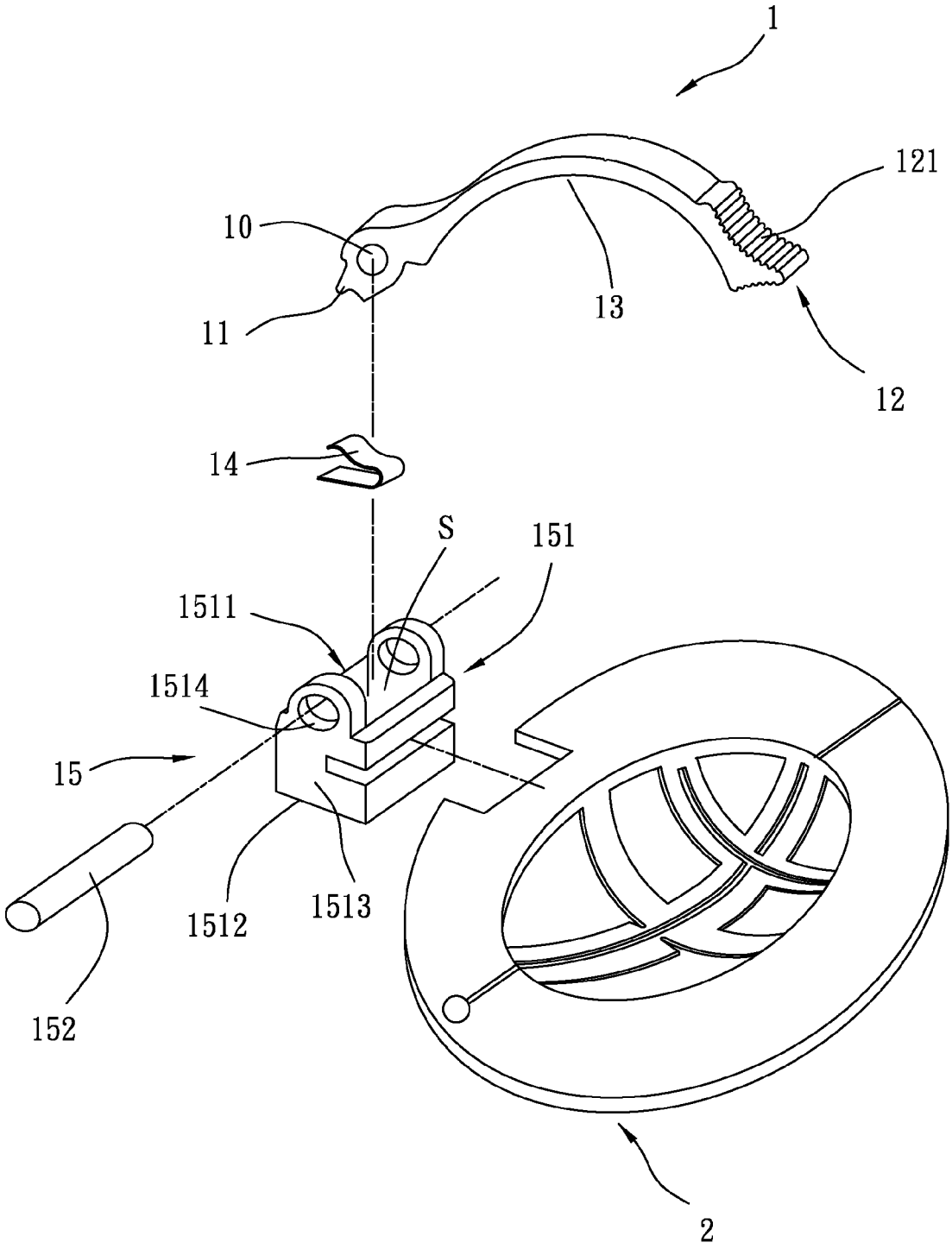
FIG. 1 is an exploded view of a ball liner and clip assembly in accordance with the present invention.
Figure 2:
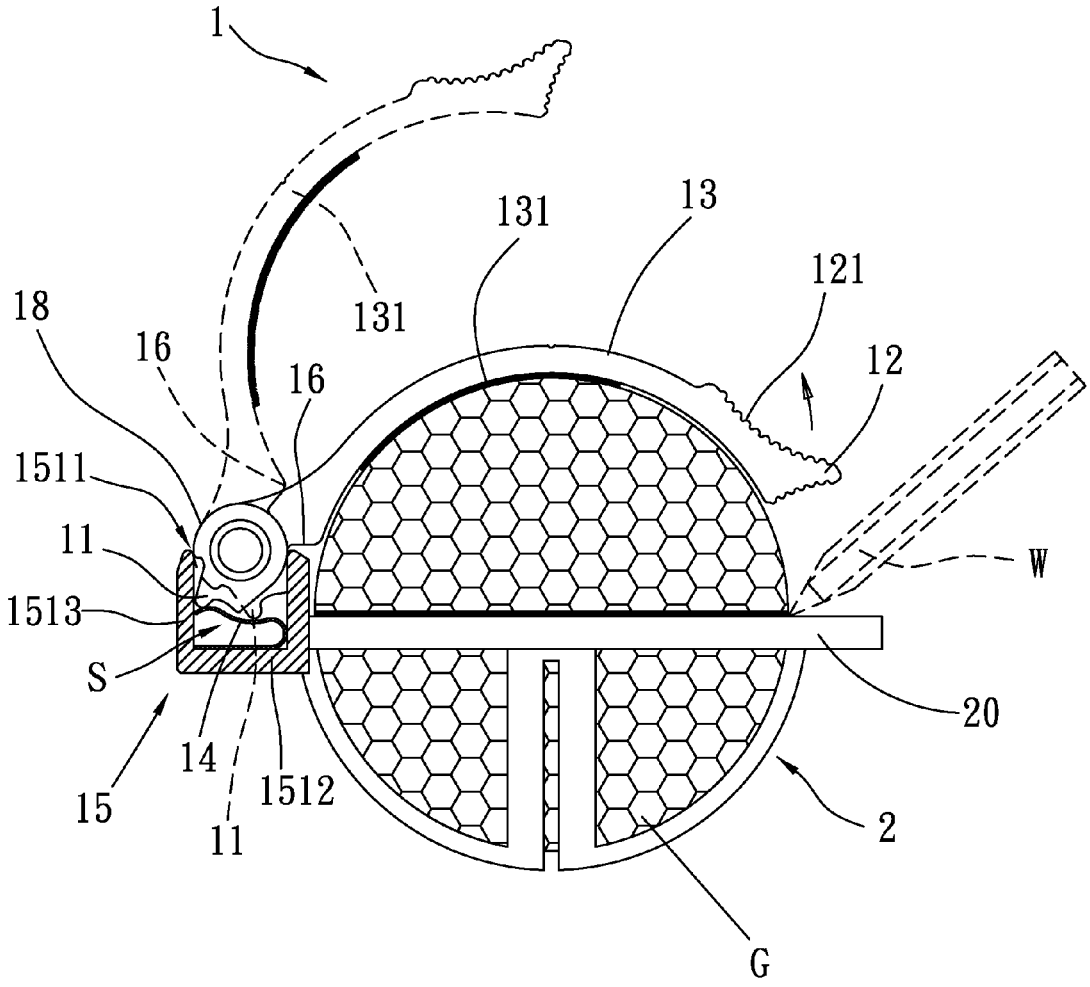
FIG. 2 is a schematic drawing showing a status of use of the ball liner and clip assembly in accordance with the present invention.

Referring to FIGS. 1 and 2, a ball clip 1 is shown used with a ball liner 2 for holding down a golf ball G in the ball liner 2 for marking aiming lines. The ball clip 1 comprises a smoothly arched clip body 13, an elastic member 14, and a mounting assembly 15 for securing the clip body 1 to the ball liner 2. The smoothly arched clip body 13 has a grip 12 formed integral with its one end, namely, the front end, a pivot hole 10 transversely cut through its other end, namely, the rear end, and a protruding block 11 protruded from the periphery of its rear end. The mounting assembly 15 is comprised of a hollow mounting block 151 and a pivot pin 152. The hollow mounting block 151 has an opening 1511, a bottom wall 1512, a peripheral wall 1513, an accommodation chamber S surrounded by the bottom wall 1512 and the peripheral wall 1513 and disposed in communication with the opening 1511, and two pivot holes 1514 cut through the peripheral wall 1513 and axially aligned at two sides above the opening 1511. The pivot pin 152 is fastened to the pivot holes 1514 of the hollow mounting block 151 and the pivot hole 10 of the smoothly arched clip body 13 to pivotally secure the smoothly arched clip body 13 to the hollow mounting block 151. The elastic member 14 is mounted in the accommodation chamber S and supported on the bottom wall 1512. When the ball clip 1 is assembled, the protruding block 11 of the smoothly arched clip body 13 is pressed on the elastic member 14, and the elastic member 14 imparts a pressure to the protruding block 11, holding the clip body 13 in a ball-holding position where the smoothly arched clip body 13 holds down a golf ball G in the ball liner 2.

Referring to FIG. 2 again, the hollow mounting block 151 of the mounting assembly 15 is fastened to the ball liner 2 to secure the smoothly arched clip body 13 to the ball liner 2, and the elastic member 14 imparts an upward pressure to the protruding block 11 of the smoothly arched clip body 13, therefore the smoothly arched clip body 13 is biased downwards toward the ball liner 2 to hold down a golf ball G in the ball liner 2. The user can lift the grip 12 with the fingers to bias the smoothly arched clip body 13 from the ball-holding position to a ball-releasing position so that the user can put a golf ball G in the ball liner 2 or take it away from the ball liner 2.

Further, the rear end of the smoothly arched clip body 13 can be made relatively thicker, enhancing its structural strength. The rear end of the smoothly arched clip body 13 is made having a smoothly arched outer surface 18 to facilitate biasing of the smoothly arched clip body 13 relative to the hollow mounting block 151.

Normally, the ball clip 1 is held in a close position on the ball liner 2, i.e., the aforesaid ball-holding position due to the effect of the springy power of the elastic member 14, holding the loaded golf ball G firmly in the ball liner 2 for marking aiming lines. Further, the smoothly arched clip body 13 has a layer of friction member 131 bonded to its inner surface for direct contact with the golf ball G in the ball liner 2 to providing an enhanced gripping force to the golf ball G in the ball liner 2.

Further, the grip 12 extends from the front end of the smoothly arched clip body 13, having an anti-slip pattern 121 that increases friction between the user's thumb and the grip 12 so that the user can positively operate the grip 12 even when the hand is wet or having a glove worn thereon.

Further, the smoothly arched slip body 13 has a stop edge 16 located at its rear end adjacent to the protruding block 11 for stopping against the topmost edge of the peripheral wall 1513 of the hollow mounting block 151 to prevent accidental impact between the smoothly arched clip body 13 and the ball liner 2 when the ball liner 2 is empty.

Figure 3:
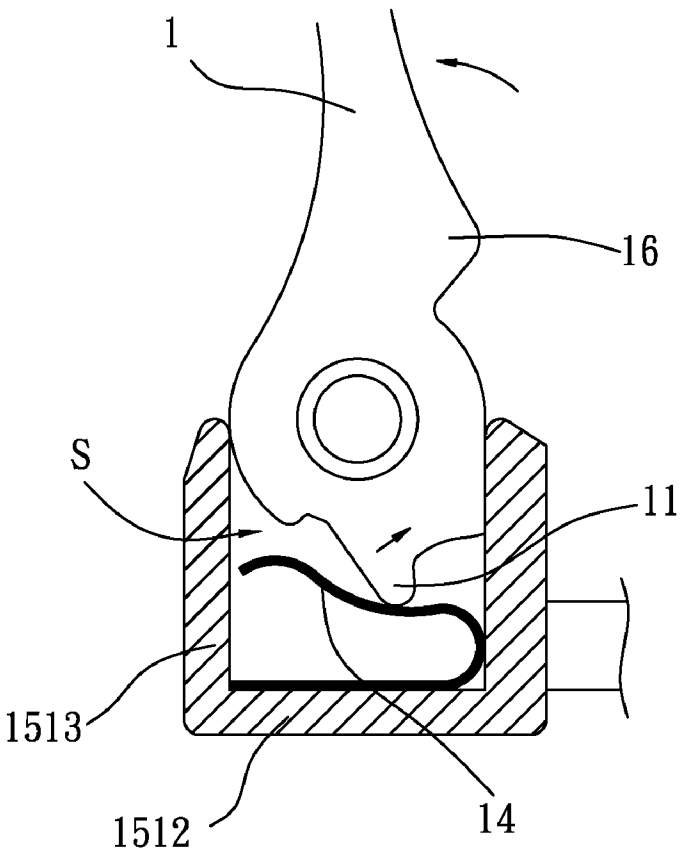
FIG. 3 is a schematic sectional view in an enlarged scale of a part of the ball clip, showing the clip body in the unlocking position.
Figure 4:
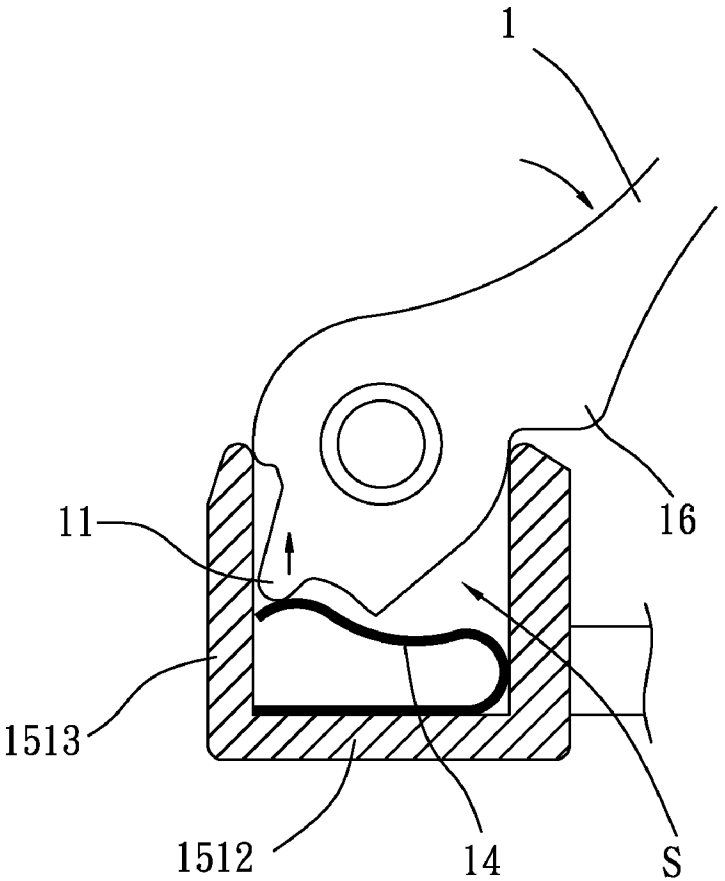
FIG. 4 corresponds to FIG. 3, showing the clip body in the ball-holding position.

Referring to FIGS. 3 and 4, the aforesaid elastic member 14 can be a spring or spring plate. According to the embodiment shown in FIGS. 3 and 4, the elastic member 14 is a substantially U-shaped spring plate set in the accommodation chamber S inside the hollow mounting block 151, having a flat bottom part positively supported on the bottom wall 1513 of the hollow mounting block 151 and a wave-like upper part 14 that supports the protruding block 11 of the smoothly arched clip body 13 and facilitates movement of the protruding block 11 of the smoothly arched clip body 13 relative to the elastic member (U-shaped spring plate) 14 as the smoothly arched clip body 13 is biased between the ball-releasing position and the ball-holding position. When biasing the smoothly arched clip body 13 relative to the hollow mounting block 151 and the ball liner 2 from the ball-releasing position to the ball-holding position, the protruding block 11 will be moved along the wave-like surface of the upper part of the elastic member (U-shaped spring plate) 14 from a relatively lower position to a relatively higher position. When the protruding block 11 is moved to the peak of one arched surface of the wave-like upper part of the elastic member (U-shaped spring plate) 14, the elastic member (U-shaped spring plate) 14 imparts an upward pressure to the protruding block 11, thereby biasing the smoothly arched clip body 13 toward the ball liner 2 to hold down the loaded golf ball G in the ball liner 2. On the contrary, when biasing the smoothly arched clip body 13 relative to the hollow mounting block 151 and the ball liner 2 from the ball-holding position to the ball-releasing position, the protruding block 11 will be moved along the wave-like surface of the upper part of the elastic member (U-shaped spring plate) 14 from a relatively higher position to a relatively lower position. When the protruding block 11 is moved over the peak of one arched surface of the wave-like upper part of the elastic member (U-shaped spring plate) 14, the protruding block 11 will be forced by the elastic member (U-shaped spring plate) 14 to have a part of the smoothly arched clip body 13 be stopped against the peripheral wall 1513 of the hollow mounting block 151, thereby holding the smoothly arched clip body 13 in the ball-releasing position.

Figure 5:
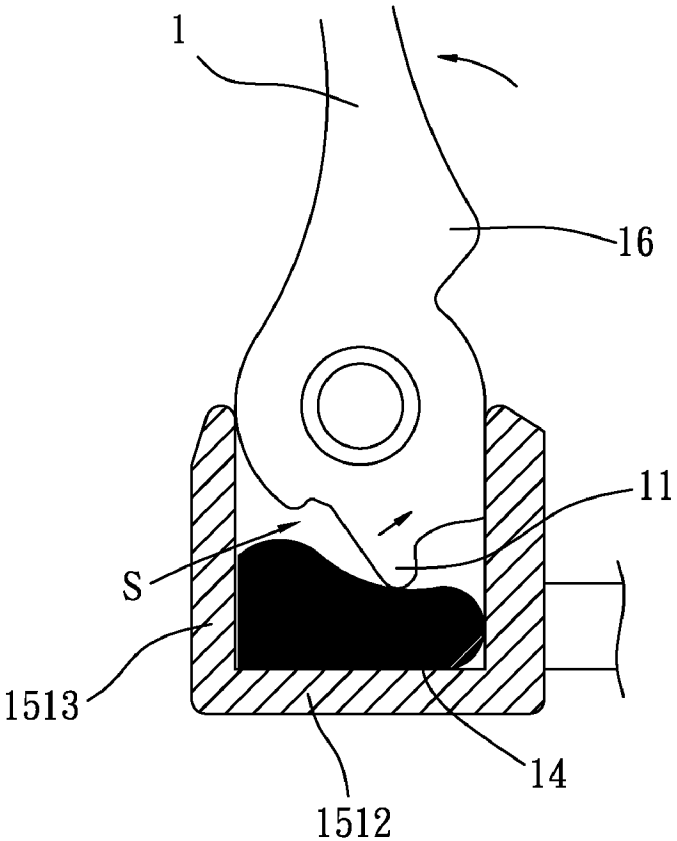
FIG. 5 is a schematic sectional view in an enlarged scale of a part of an alternate form of the ball clip, showing the elastic member formed of a rubber block and the clip body turned to a ball-releasing position.
Figure 6:
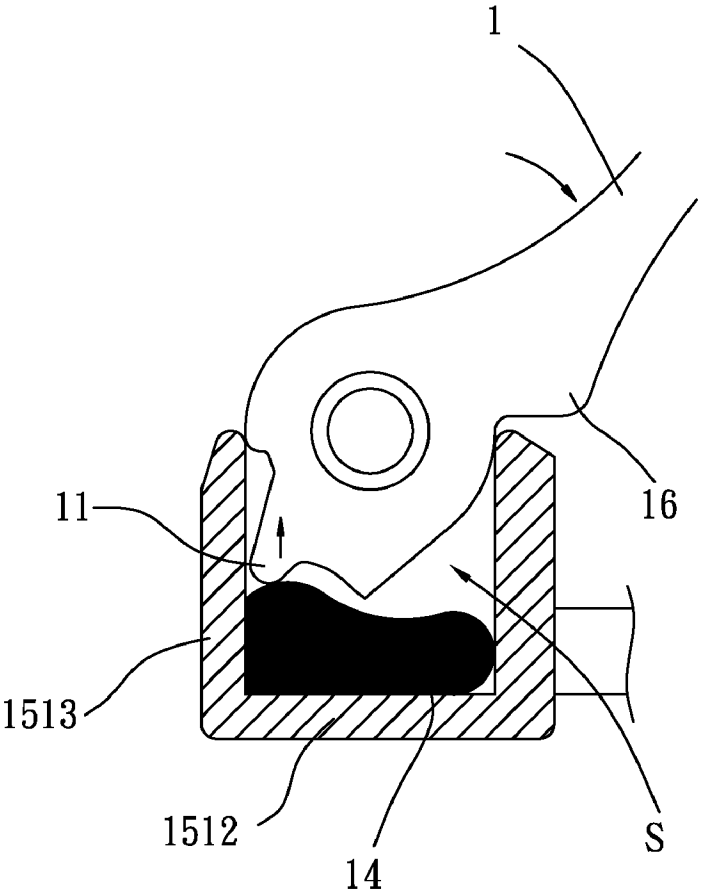
FIG. 6 corresponds to FIG. 5, showing the clip body in the ball-holding position.

FIGS. 5 and 6 show an alternate form of the elastic member 14. According to this embodiment, the elastic member 14 is formed of a rubber block having a flat bottom surface and a wave-like top surface. When biasing the smoothly arched clip body 13 relative to the hollow mounting block 151 and the ball liner 2 from the ball-releasing position to the ball-holding position, the protruding block 11 is moved to the peak of one arched surface of the wave-like upper surface of the elastic member (rubber block) 14, the elastic member (rubber block) 14 imparts an upward pressure to the protruding block 11, thereby biasing the smoothly arched clip body 13 toward the ball liner 2 to hold down the loaded golf ball G in the ball liner 2. On the contrary, when biasing the smoothly arched clip body 13 relative to the hollow mounting block 151 and the ball liner 2 from the ball-holding position to the ball-releasing position, the protruding block 11 will be moved along the wave-like top surface of the elastic member (rubber block) 14 from a relatively higher position to a relatively lower position. When the protruding block 11 is moved over the peak of one arched surface of the wave-like upper part of the elastic member (rubber block) 14, the protruding block 11 will be forced by the elastic member (rubber block) 14 to have a part of the smoothly arched clip body 13 be stopped against the peripheral wall 1513 of the hollow mounting block 151, thereby holding the smoothly arched clip body 13 in the ball-releasing position.

Figure 7:
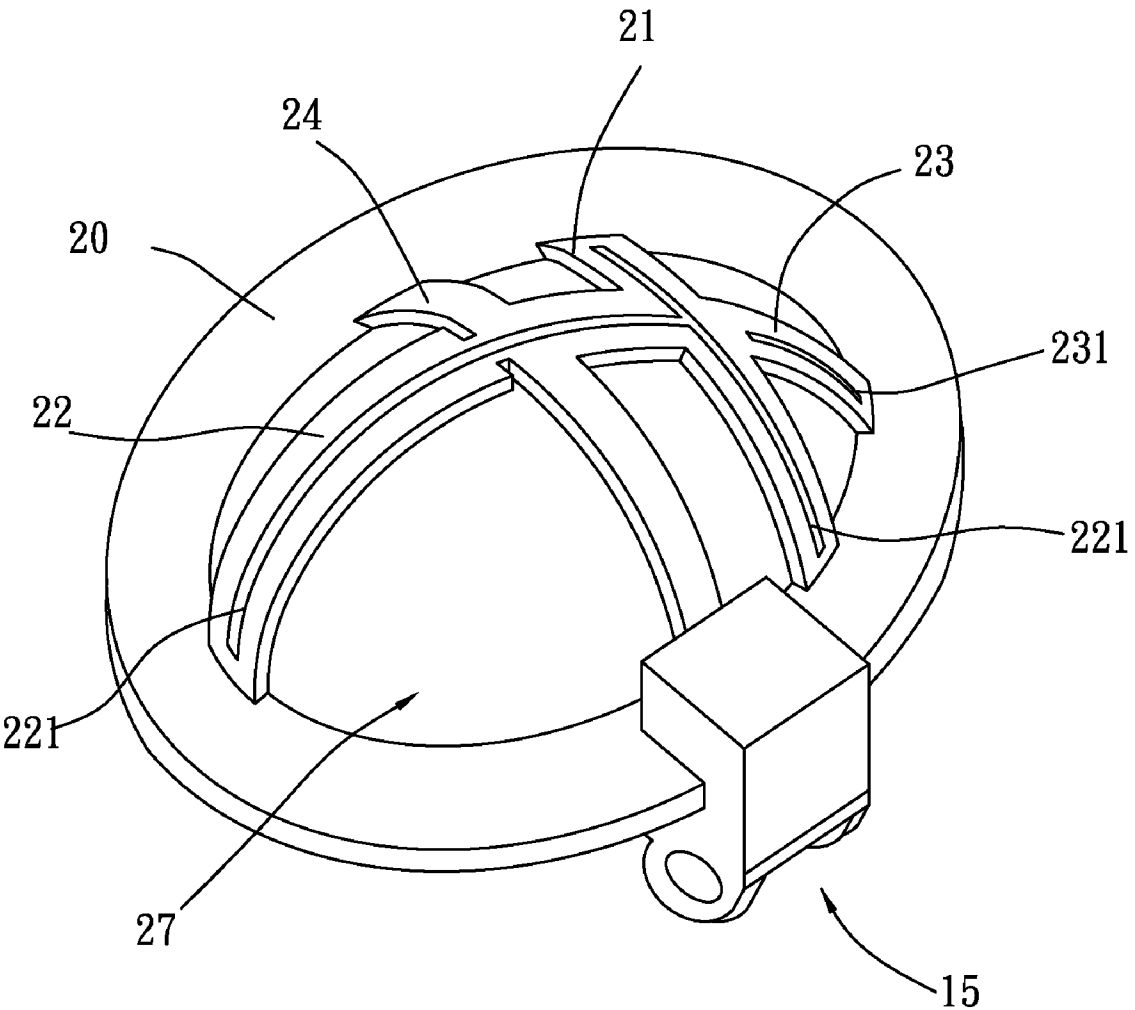
FIG. 7 is an oblique elevational of the ball liner and clip assembly in accordance with the present invention.
Figure 8:
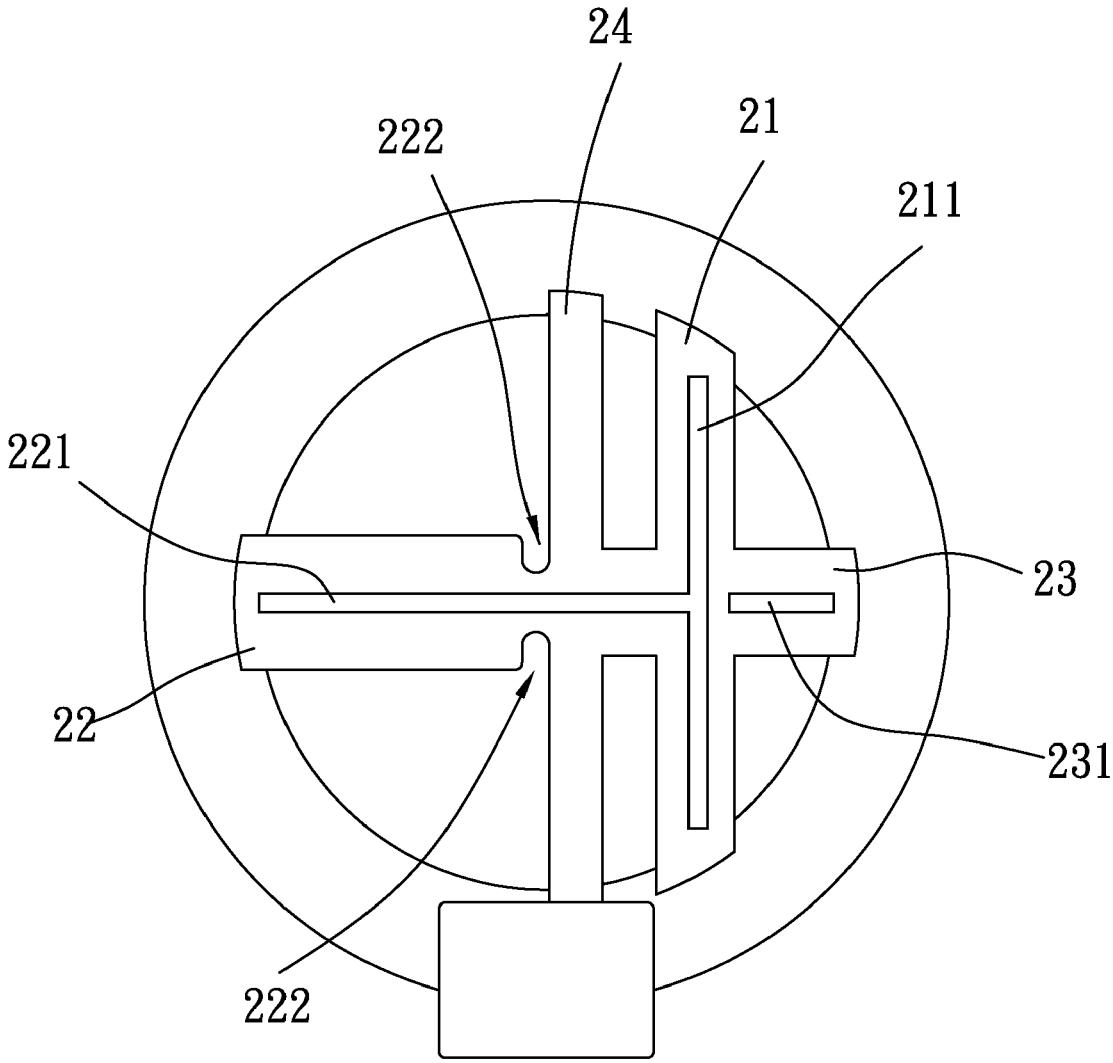
FIG. 8 is a top plain view of the ball liner and clip assembly in accordance with the present invention.
Figure 9:
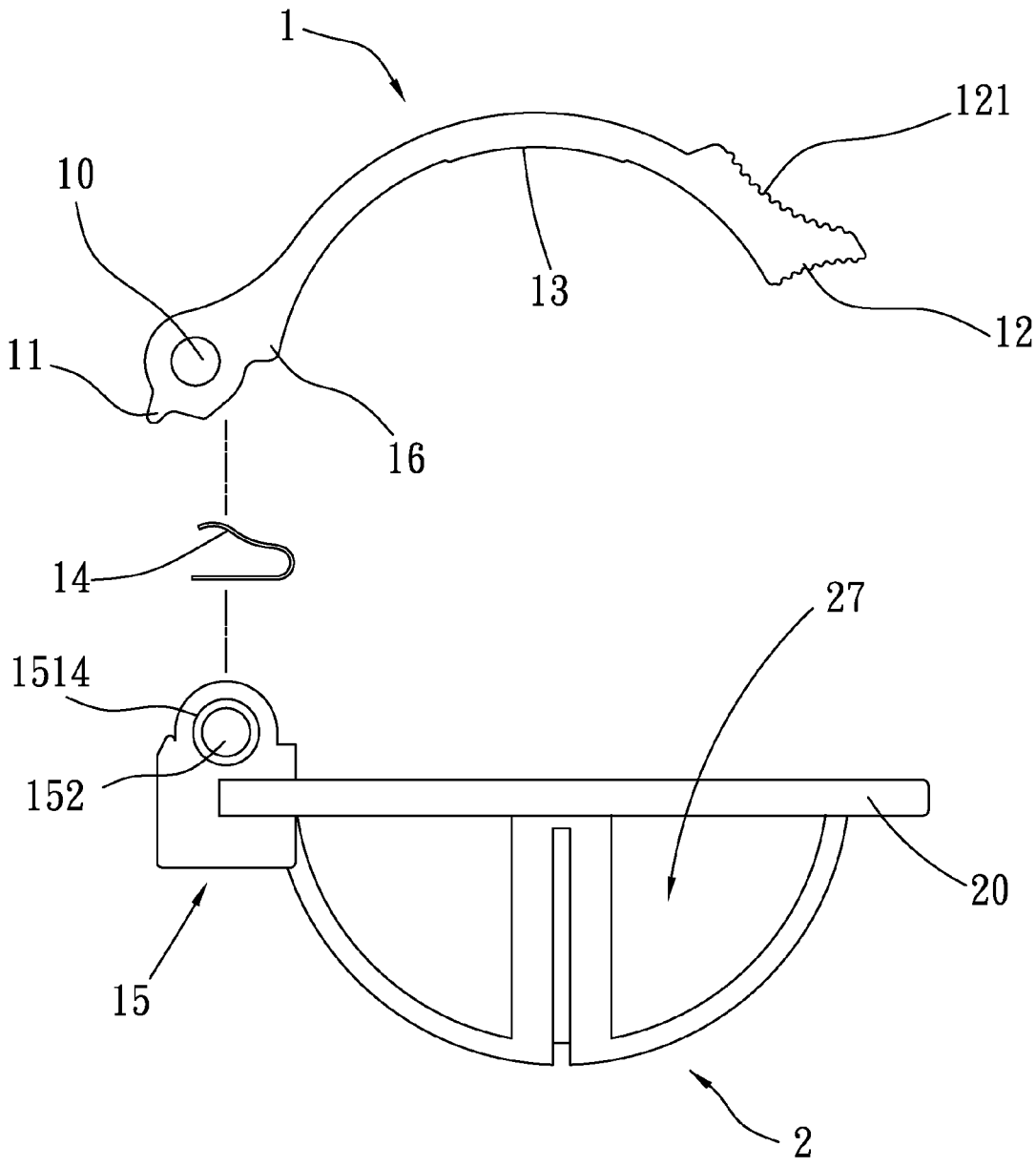
FIG. 9 is an exploded side plain view of the ball liner and clip assembly in accordance with the present invention.

Referring to FIGS. 7 through 9, the aforesaid ball line 2 comprises an annular scale 20, a first arched scale 21, a second arched scale 22. The hollow mounting block 151 of the mounting assembly 15 of the aforesaid ball clip 1 is fastened to the annular scale 20. The first arched scale 21 bridges the annular scale 20 at a location shorter than one half of the length of the annular scale 20. The second arched scale 22 has one end perpendicularly to the midpoint of one lateral side of the first arched scale 21 and the other end connected to the annular scale 20. The third arched scale 23 has one end perpendicularly to the midpoint of the other lateral side of the first arched scale 21 and the other end connected to the annular scale 20. The first arched scale 21 and the second arched scale 22 extend in a perpendicular manner relative to each other. The first arched scale 21 and the third arched scale 23 extend in a perpendicular manner relative to each other. The second arched scale 22 and the third arched scale 23 may be connected in a line, or arranged in a parallel manner. According to this embodiment, the second arched scale 22 and the third arched scale 23 are connected in a line.

The annular scale 20, the first arched scale 21, the second arched scale 22 and the third arched scale 23 define a ball accommodation space 27 for accommodating a golf ball for enabling the user to mark aiming lines on the golf ball. The first arched scale 21 is adapted for marking an aiming line on a golf ball such that the aiming line is visually biased to one side of the golf ball as the player aims the club head at the golf ball.

The ball liner 2 further comprises a fourth arched scale 24 bridging the annular scale 20 and intersected with the second arched scale 22. The circumference of the fourth arched scale 24 is equal to the annular scale 20. The third arched scale 24 is adapted to enhance the stability of the loaded golf ball and to be used for marking another line on the loaded gold ball.

Figure 10:
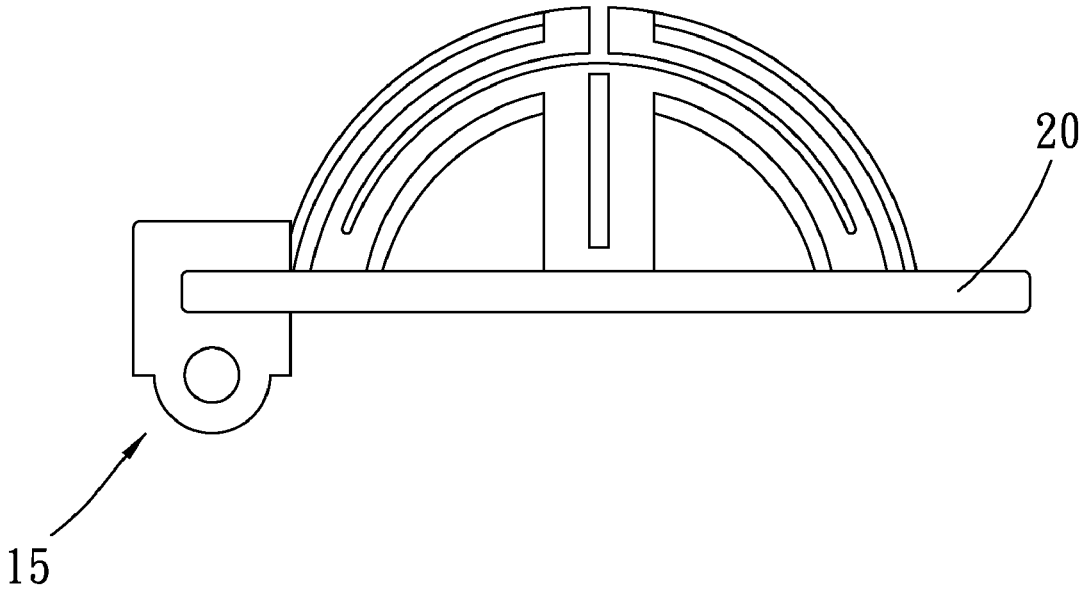
FIG. 10 is a side plain view of the ball liner and clip assembly in accordance with the present invention.

Referring to FIG. 10 and FIG. 1 again, the hollow mounting block 151 of the mounting assembly 15 of the ball clip 1 may be fastened to the annular scale 20 of the ball liner 2 by means of a press-fit joint, adhesive technique or hot-melt bonding technique (see FIG. 1), or formed integral with the annular scale 20 of the ball liner 2 (see FIG. 10).

Figure 11:
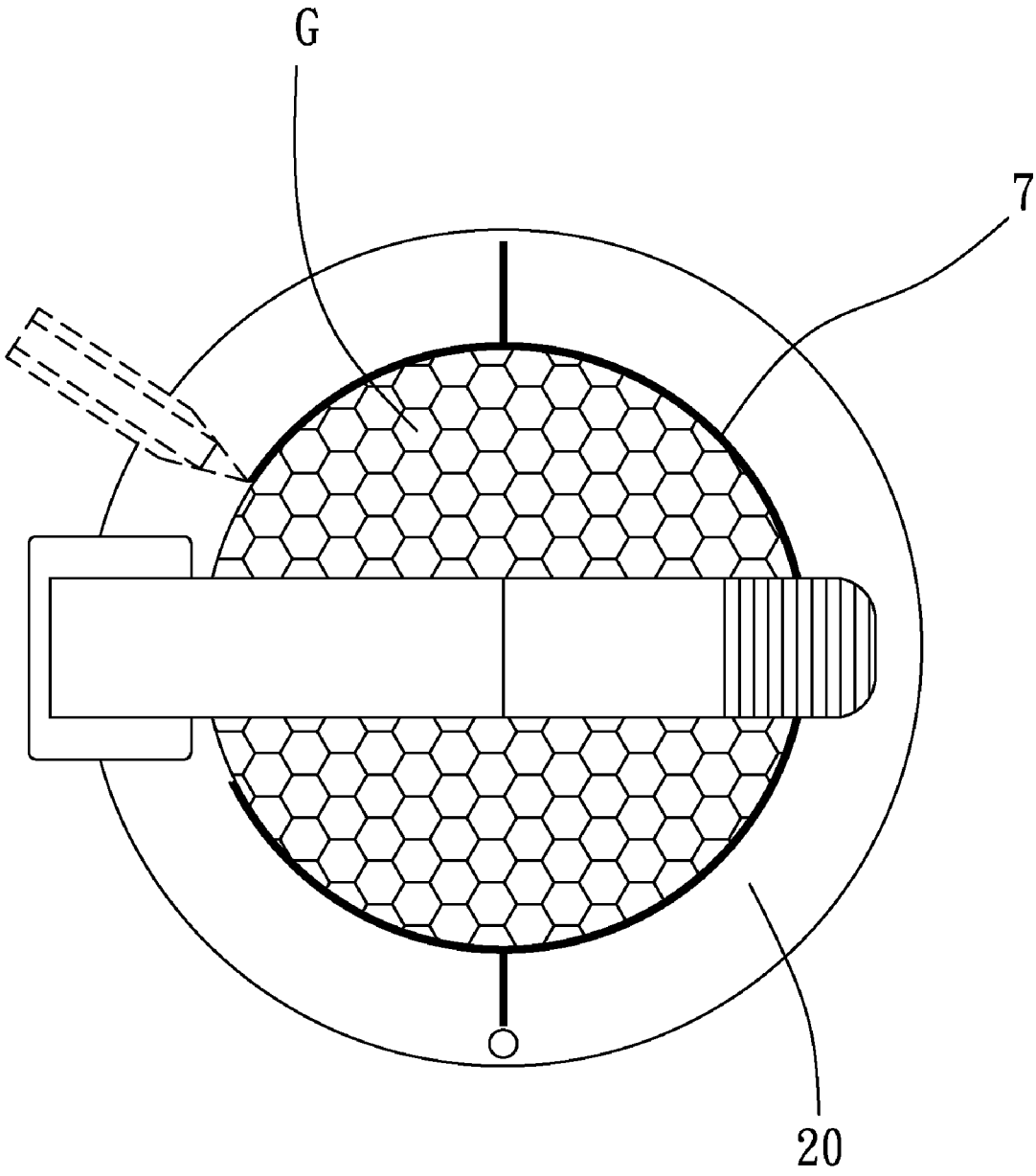
FIG. 11 is a schematic drawing showing a 360-degree horizontal line marking operation of the ball liner and clip assembly in accordance with the present invention.

Referring to FIG. 11, by means of the annular scale 20, the user can draw a 360° horizontal line 7 on the surface of the golf ball G so that when putting the golf ball G with a golf putter toward the hole, the player can visually check the horizontal alignment of the horizontal line 7 on the golf ball G with the ground of the green and then estimate and adjust the precision of the directional guideline to guide the golf ball putting action. By means of the annular scale 20, the user can draw a 360° reference line along the seam line of the golf ball. By means of the guidance of the 360° reference line on the golf ball, the user can precisely control the balance of the golf ball when hitting the golf ball with a golf club.

Figure 12:
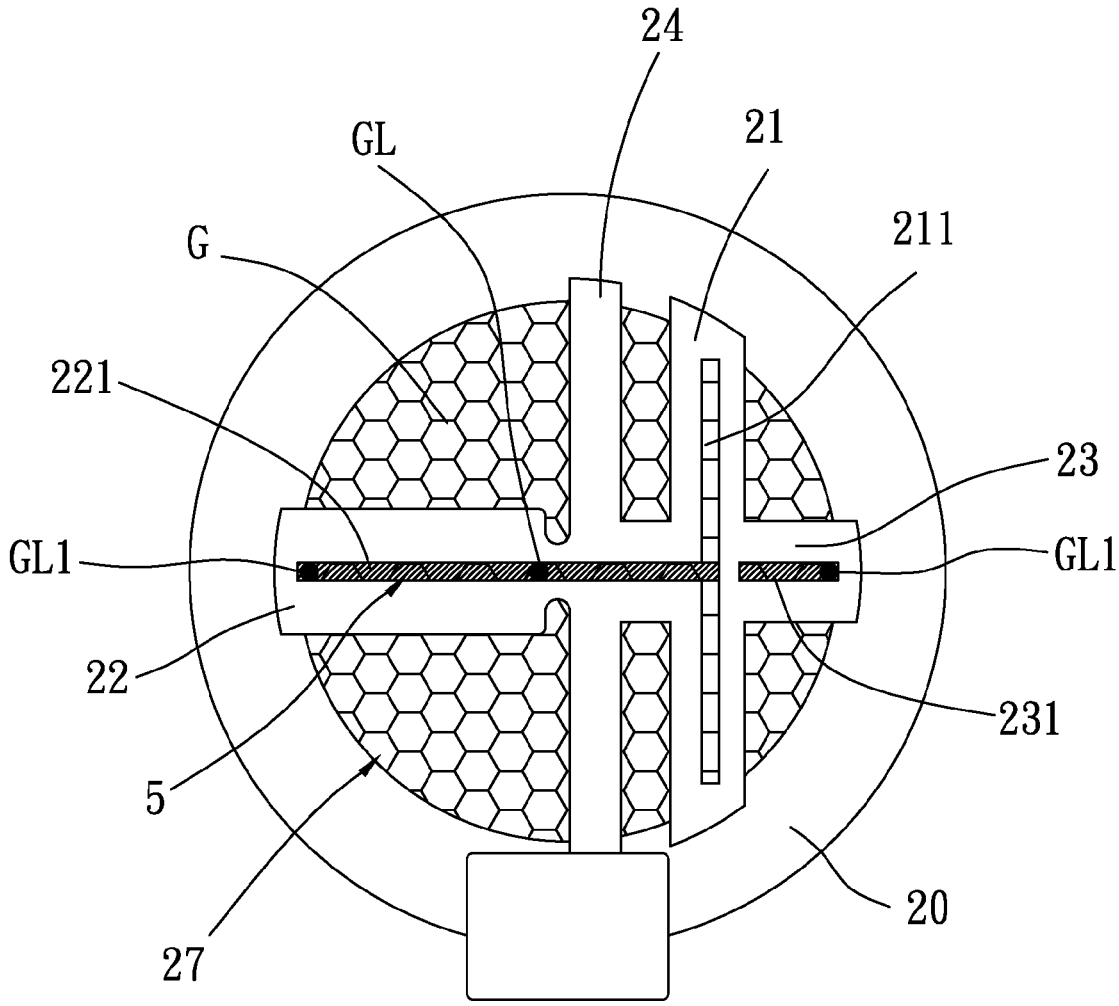
FIG. 12 is a schematic drawing showing a line-marking application example of the ball liner and clip assembly in accordance with the present invention.
Figure 13:
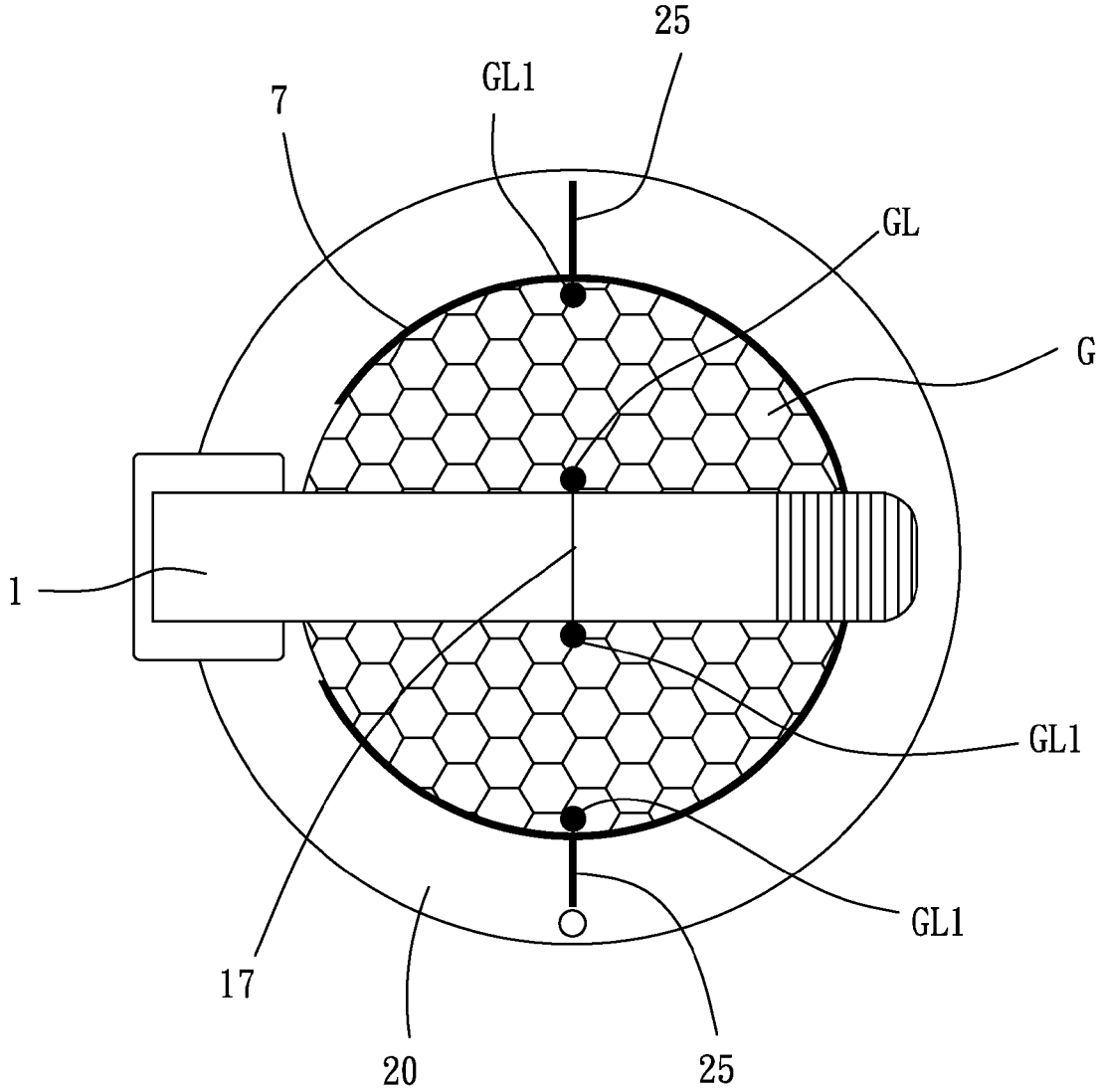
FIG. 13 is a top view of the present invention, showing a golf ball held in between the ball liner and the ball clip, and marks marked on the golf ball.

Referring to FIGS. 12 and 13, because the gravity center of every golf ball G is not at the same location. The center of gravity of one golf ball may be at the center while the center of gravity of another golf ball may be slightly based from the center. When marking a 360° reference line on a golf ball without making sure of the center of gravity of the golf ball, the 360° reference line may be unable to provide accurate guidance to the user. Before marking a 360° reference line on a golf ball, it is suggested to put the golf ball G in a fluid, for example, salty water. When a golf ball is put in salty water, the center of gravity of the golf ball will move to the right bottom side. At this time, the user can mark a mark GL on the golf ball G at a location corresponding to the fluid level for finding the center of gravity of the golf ball G, and then draw a 360° reference line on the surface of the golf ball G accurately.

When drawing a 360° reference line, the user can insert the finger through an open space in the ball liner 2 and the rotate the golf ball G in the ball accommodation space 27 to the best position conveniently for marking a 360° reference line, and then turn the smoothly arched clip body 13 to the ball-holding position to hold down the golf ball G in the ball liner 2 (see also FIG. 2). Thereafter, aim the mark GL at an index 17 at the smoothly arched clip body 13 of the ball clip 1 and an index 25 at the annular scale 20, and then mark at least one mark GL1 on the surface of the golf ball G at a location or locations in line with the mark GL and the indexes 17 and 25, and then turn the combination of the ball clip 1 and the ball liner 2 upside down, and then insert the marker (not shown) through the slot 221 on the second arched scale 22 and the slot 231 on the third arched scale 23 draw a dotted 180° circumferential line on the surface of the golf ball G (see FIG. 12). Thereafter, open the ball clip 1, and then rotate the golf ball G in the ball accommodation space 27 to have the marks GL and GL1 be in alignment with the slot 221 on the second arched scale 22 and the slot 231 on the third arched scale 23, and then draw another 180° circumferential line on the opposite side of the golf ball G. Thus, the marking of a dotted 360° guide line 5 on the surface of the golf ball G is done. By means of the guidance of the 360° guideline 5, the user can accurately control the balance of the rotation of the golf ball G when putting the golf ball G on the green toward the hole.

Referring to FIG. 8 again, the first arched scale 21 defines a first slot 211 along its length, the second scale 22 defines a second slot 221 along its length, and the third scale 23 defines a third slot 231 along its length. The user can insert the pen W into the slot 211, 221, 231 to draw a directional guideline on the surface of the golf ball G stably without vibration. Further, the line drawn on the surface of the golf ball G along the second slot 221 is in line with the line drawn on the surface of the golf ball G along the third slot 231. The slots 211, 221, 231 are elongated straight slots. Further, the first slot 211 is in communication with the second slot 221. Further, two notches 222 disposed at two sides of the second arched scale 22 and abutted to one side of the fourth arched scale 24 so that the user can draw two axis lines along one lateral side of the fourth arched scale 24 and the first arched scale 2 that are close to each other for easy visual check.

Figure 14:
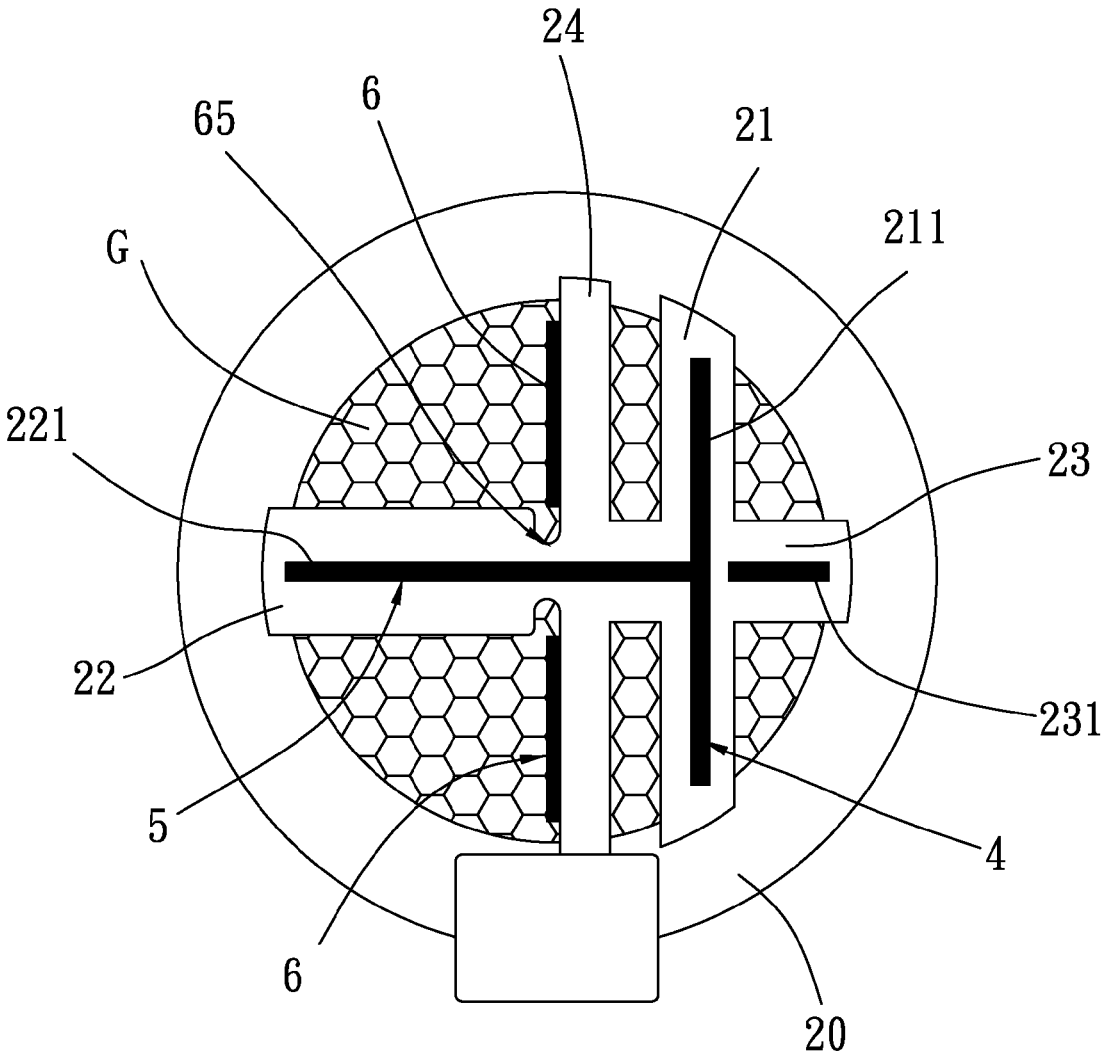
FIG. 14 is a schematic drawing showing another line-marking application example of the ball liner and clip assembly in accordance with the present invention.

Referring to FIG. 14, after adjustment of the position of the golf ball G in the ball liner, draw a club head guideline 4 on the surface of the golf ball G along the first slot 211 on the first arched scale 21 that is visually biased to one side of the golf ball G. When putting the golf ball G, the user can visually check whether or not the club head is kept in parallel to the club head guideline 4. By means of the guidance of the club head guideline 4, the face of the club head (the head of the putter) can drive the golf ball G toward the hole accurately. Thereafter, the user can move the writing tip of the marker along the slot 221 of the second arched scale 22 and the slot 231 of the third arched scale 4 to draw a directional guideline 5 on the surface of the golf ball G for aiming the golf ball G at the hole. By means of the directional guideline 5, the user (player) can see whether the rolling direction of the rolling golf ball G is accurate or biased from the accurate direction. Further, because the ball clip 1 does extend across the annular scale 20 and protrudes over the top side of the annular scale 20 at a distance, as shown in FIG. 2, the ball clip 1 does not hinder the user from drawing a line on the surface of the golf ball G along the inner diameter of the annular scale 20.

Further, by means of the fourth arched scale 24, the user can draw an arched line 6 on the surface of the golf ball G. The arched line 6 and the directional guideline 5 are in a crossed manner 65. The intersection between the arched line 6 and the directional guideline 5 is the center of the directional guideline 5. By means of the intersection 65 between the arched line 6 and the directional guideline 5, the user can visually check whether the marked lines are in balance or not when the golf ball G is placed on the lawn. The arched line 6 can also be used as a guideline similar to the function of the club head guideline 4.

Figure 15:
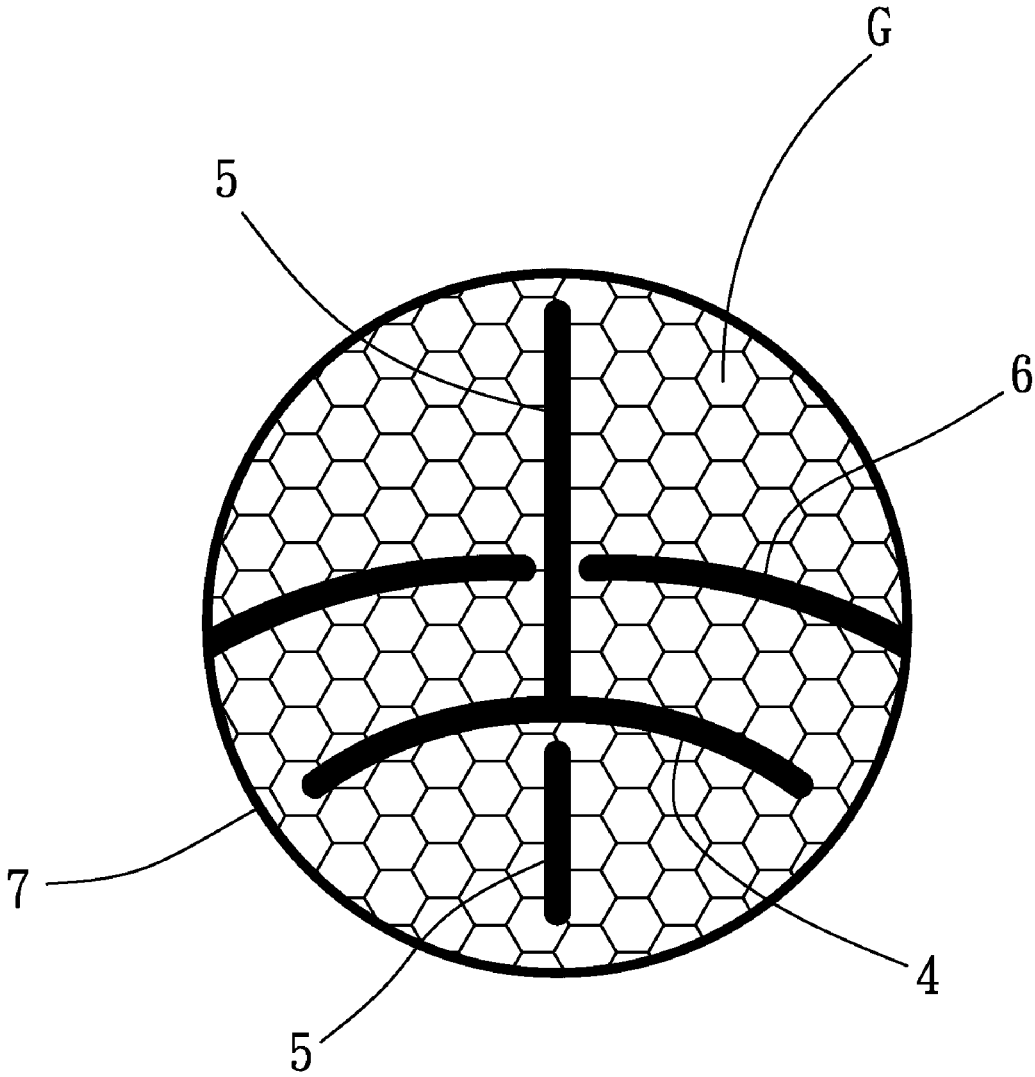
FIG. 15 is a schematic drawing showing aiming lines marked on a golf ball according to the present invention.

FIG. 15 illustrates the golf ball G marked with the aforesaid guidelines 4,5,6. After marking of the guidelines 4,5,6, the golf ball G is put on the lawn, and the user (player) can visually check the 360° horizontal line 7 to see whether the golf ball G is kept in parallel to the lawn or not. When the 360° horizontal line 7 is kept in parallel to the lawn, the directional guideline 5 can guide the player accurately when the player is aiming the golf ball G to the hole (not shown). At this time, the user can hold the club head in the putting position to keep the face of the club head in parallel to the club head guideline 4, and then put the golf ball G accurately to the hole. When the golf ball G is rolling toward the hole, the user can visually check the directional guideline 5 to see whether the golf ball G is rotating in the correct direction or not. Therefore, by means of the club head guideline 4, the directional guideline 5 and the 360° horizontal line 7, the user (player) can visually check and adjust the position of the golf ball G and the putting angle of the golf club.

As indicated above, the invention provides a ball liner for drawing guidelines on a golf ball before hitting the golf ball, and a ball clip for holding a golf ball positively in the ball liner for marking guidelines.

Although a particular embodiment of the invention has been described in detail for purposes of illustration, various modifications and enhancements may be made without departing from the spirit and scope of the invention.

What is claimed is:

1. A ball clip for use with a ball liner to hold a golf ball firmly in the ball liner for marking guidelines, the ball clip comprising:

a smoothly arched clip body for holding down a golf ball in said ball liner, said smoothly arched clip body having a front end, a rear end, a grip extending from said front end, a pivot hole transversely cut through said rear end, and a protruding block protruded from the periphery of said rear end;

a hollow mounting block fastened to said ball liner, said hollow mounting block comprising an opening, a bottom wall, a peripheral wall, an accommodation chamber surrounded by said bottom wall and said peripheral wall and disposed in communication with said opening, and two pivot holes cut through said peripheral wall and axially aligned at two sides above said opening;

a pivot pin fastened to the pivot holes of said hollow mounting block and the pivot hole of said smoothly arched clip body to pivotally secure said smoothly arched clip body to said hollow mounting block; and an elastic member mounted in said accommodation chamber and stopped said bottom wall of said hollow mounting block and said protruding block of said smoothly arched clip body to impart an upward pressure to said protruding block of said smoothly arched clip body.

2. The ball clip as claimed in claim 1, wherein the rear end of said smoothly arched clip body has a smoothly arched outer surface.

3. The ball clip as claimed in claim 1, wherein said elastic member is a substantially U-shaped spring plate, said U-shaped spring plate having a bottom side fastened to said bottom wall of said hollow mounting block and a wave-like top side stopped against the protruding block of said smoothly arched clip body.

4. The ball clip as claimed in claim 1, wherein said elastic member is a rubber block, said rubber block having a bottom side fastened to said bottom wall of said hollow mounting block and a wave-like top side stopped against the protruding block of said smoothly arched clip body.

5. A combination ball clip and ball liner comprising:

a ball liner for marking guidelines on a golf ball; and a ball clip fastened to said ball liner for holding down a golf ball in said ball liner for marking guidelines, said ball clip comprising:

a smoothly arched clip body for holding down a golf ball in said ball liner, said smoothly arched clip body having a front end, a rear end, a grip extending from said front end, a pivot hole transversely cut through said rear end, and a protruding block protruded from the periphery of said rear end;

a hollow mounting block fastened to said ball liner, said hollow mounting block comprising an opening, a bottom wall, a peripheral wall, an accommodation chamber surrounded by said bottom wall and said peripheral wall and disposed in communication with said opening, and two pivot holes cut through said peripheral wall and axially aligned at two sides above said opening;

a pivot pin fastened to the pivot holes of said hollow mounting block and the pivot hole of said smoothly arched clip body to pivotally secure said smoothly arched clip body to said hollow mounting block; and an elastic member mounted in said accommodation chamber and stopped said bottom wall of said hollow mounting block and said protruding block of said smoothly arched clip body to impart an upward pressure to said protruding block of said smoothly arched clip body.

6. The combination ball clip and ball liner as claimed in claim 5, wherein said ball liner comprising:

an annular scale, said annular scale defining therein a center hole;

a first arched scale bridging said annular scale over said circular center hole;

a first slot cut through and extending along the length of said first arched scale;

a second arched scale connected between the midpoint of one lateral side of said first arched scale and said annular scale, said second arched scale extending in a direction perpendicular to said first arched scale;

a second slot cut through and extending along the length of said second arched scale;

a third arched scale connected between the midpoint of an opposite lateral side of said first arched scale and said annular scale, said third arched extending in a direction perpendicular to said first arched scale and in line with said second arched scale; and a third slot cut through and extending along the length of said third arched scale.

7. The combination ball clip and ball liner as claimed in claim 5, wherein said hollow mounting block of said ball clip is formed integral with said annular scale of said ball liner.

8. The combination ball clip and ball liner as claimed in claim 6, wherein said ball liner further comprises a fourth arched scale bridging said annular scale and intersected with said second arched scale.

9. The combination ball clip and ball liner as claimed in either of claims 6~8, wherein said ball liner further comprises a mark marked on said annular scale; said ball clip further comprises a mark marked on said smoothly arched clip body.

10. The combination ball clip and ball liner as claimed in claim 6, wherein said first slot is in communication with said second slot; said second slot and said third slot are aligned in line.

11. The combination ball clip and ball liner as claimed in claim 8, wherein said second arched scale has two notches symmetrically disposed on two opposite lateral sides thereof and abutted against one lateral side of said fourth arched scale.

* * * * *